US011686080B2

(12) United States Patent
Rapp

(10) Patent No.: US 11,686,080 B2
(45) Date of Patent: Jun. 27, 2023

(54) SHOWER BIDET

(71) Applicant: TMP Inc., Marietta, GA (US)

(72) Inventor: Curt V. Rapp, Atlanta, GA (US)

(73) Assignee: TMP Inc., Marietta, GA (US)

( * ) Notice: Subject to any disclaimer, the term of this patent is extended or adjusted under 35 U.S.C. 154(b) by 0 days.

(21) Appl. No.: 17/162,248

(22) Filed: Jan. 29, 2021

(65) Prior Publication Data

US 2022/0243444 A1 Aug. 4, 2022

(51) Int. Cl.
*E03D 9/08* (2006.01)
*A47K 3/28* (2006.01)

(52) U.S. Cl.
CPC ..... *E03D 9/085* (2013.01); *A47K 3/281* (2013.01)

(58) Field of Classification Search
CPC ..... E03D 9/085; A47K 3/281; A47K 3/26; A47K 3/122; A47K 3/282
USPC ..... 4/596, 444, 447, 448, 611
See application file for complete search history.

(56) References Cited

U.S. PATENT DOCUMENTS 1,406,779 A * 2/1922 Thibadore ..... A47K 3/282 4/567
3,040,335 A * 6/1962 Gellmann ..... A47K 3/122 4/570
3,082,432 A * 3/1963 Pearlman ..... A61M 3/0225 4/444
3,134,985 A * 6/1964 Di Pasquale ..... A47K 3/26 4/447
3,164,846 A * 1/1965 Foster ..... A61M 3/0208 4/420.1
3,181,534 A * 5/1965 Davis ..... E03D 9/085 4/578.1
3,196,465 A * 7/1965 Montgomery ..... A47K 3/122 4/578.1
3,528,112 A * 9/1970 Warnick ..... A47K 3/12 4/447
3,711,872 A * 1/1973 Jarosinski ..... A47K 3/022 4/604
3,900,902 A * 8/1975 Jarosinski ..... A47K 4/00 4/444
3,916,453 A * 11/1975 Dominguez-Armada ..... E03D 9/085 4/445
4,123,808 A * 11/1978 Guarrera ..... A47K 3/03 4/447
4,287,618 A * 9/1981 Silver ..... A47K 3/022 4/444
4,574,409 A * 3/1986 McAffrey ..... A47K 3/122 4/579
5,101,520 A * 4/1992 Lockhart ..... E03D 9/08 4/420.4

(Continued)

*Primary Examiner* — David P Angwin
*Assistant Examiner* — William R Klotz
(74) *Attorney, Agent, or Firm* — Quinn IP Law

(57) ABSTRACT

A shower bidet is provided. The shower bidet includes a plastic device operable for a user to sit upon. The plastic device includes a first seating surface disposed atop a first seating column, a second seating surface disposed atop a second seating column, and a bridge portion connecting the first seating column and the second seating column. The first seating surface and the first seating column are separated from the second seating surface and the second seating column such that a spray nozzle may be disposed between the first seating column and the second seating column.

9 Claims, 10 Drawing Sheets

(56) References Cited

U.S. PATENT DOCUMENTS

| | | | | |
|---|---|---|---|---|
| 5,551,098 | A * | 9/1996 | Wilk | E03D 9/085 4/445 |
| 5,581,825 | A * | 12/1996 | Honsvald | E03D 9/08 4/444 |
| 6,339,853 | B1 * | 1/2002 | Apostolo | E03D 9/08 4/444 |
| 10,076,215 | B1 * | 9/2018 | Quay | A47K 3/122 |
| 10,595,682 | B2 * | 3/2020 | Racanelli | A47K 3/282 |
| 11,357,368 | B1 * | 6/2022 | Olsen | A47K 13/24 |
| 2010/0306912 | A1 * | 12/2010 | McCabe | E03D 9/085 4/443 |
| 2012/0159748 | A1 * | 6/2012 | Carney | A47K 3/281 24/457 |
| 2013/0326803 | A1 * | 12/2013 | Maleki | B05B 1/3013 4/448 |
| 2019/0301147 | A1 * | 10/2019 | Wu | E03C 1/0404 |
| 2019/0350412 | A1 * | 11/2019 | Dickinson | A47K 3/282 |
| 2020/0015635 | A1 * | 1/2020 | Racanelli | A61G 5/1002 |

* cited by examiner

SHOWER BIDET

INTRODUCTION

The disclosure generally relates to a shower bidet, a system for a shower bidet, and a method for utilizing a shower bidet.

A bidet is a sanitary fixture enabling a user to clean in a context of toileting. Bidets in the art may appear similar to a toilet, including a ceramic fixture attached to a restroom floor, with water pipes and a dedicated sewer pipe providing and disposing of flows to and from the bidet, respectively.

SUMMARY

A shower bidet is provided. The shower bidet includes a plastic device operable for a user to sit upon. The plastic device includes a first seating surface disposed atop a first seating column, a second seating surface disposed atop a second seating column, and a bridge portion connecting the first seating column and the second seating column. The first seating surface and the first seating column are separated from the second seating surface and the second seating column such that a spray nozzle may be disposed between the first seating column and the second seating column.

In some embodiments, the bridge portion includes a shower spray nozzle attachment feature.

In some embodiments, the shower spray nozzle attachment feature includes an arcuate profile spanning up to one hundred and eighty degrees.

In some embodiments, the shower spray nozzle attachment feature includes an arcuate profile spanning more than one hundred and eighty degrees.

In some embodiments, the bridge portion includes a first bridge portion, and the plastic device further includes a second bridge portion.

In some embodiments, the first seating surface and the second seating surface are joined to form a U-shaped continuous seating surface.

According to one alternative embodiment, a system including a shower bidet is provided. The system includes a plastic device operable for a user to sit upon. The plastic device includes a first seating surface disposed atop a first seating column, a second seating surface disposed atop a second seating column, and a bridge portion connecting the first seating column and the second seating column. The system further includes a shower spray nozzle attached to the plastic device. The shower spray nozzle is operable to include a flow of water. The first seating surface and the first seating column are separated from the second seating surface and the second seating column such that the shower spray nozzle may be disposed between the first seating column and the second seating column. The shower bidet is operable to direct the flow of water upward from below the first seating surface and the second seating surface.

In some embodiments, the bridge portion includes a shower spray nozzle attachment feature.

In some embodiments, the shower spray nozzle attachment feature includes an arcuate profile spanning up to one hundred and eighty degrees.

In some embodiments, the shower spray nozzle attachment feature includes an arcuate profile spanning more than one hundred and eighty degrees.

In some embodiments, the bridge portion includes a first bridge portion, and the plastic device further includes a second bridge portion.

In some embodiments, the first seating surface and the second seating surface are joined to form a U-shaped continuous seating surface.

According to one alternative embodiment, a method to utilize a shower bidet includes placing the shower bidet in a location including one of over a shower drain or in an area such that water draining under the shower bidet has a direct path to the shower drain. The method further includes affixing a shower spray nozzle attached to a flexible water supply hose to the shower bidet, wherein the spray nozzle oriented to enable a spray of water in an upward direction under a seating surface of the shower bidet. The method further includes activating a water flow through the shower spray nozzle.

The above features and advantages and other features and advantages of the present disclosure are readily apparent from the following detailed description of the best modes for carrying out the disclosure when taken in connection with the accompanying drawings.

DETAILED DESCRIPTION

A device is provided which includes a bidet for use in a shower or a shower bidet. A bidet provides for a flow of water to be provided in an upward direction under a toilet-style seat. The shower bidet provides a seating surface enabling a user to sit upon the device, and the shower bidet further provides an under-seat depression or surface receding away from the seating surface and operable to enable the user to project a shower nozzle with a flexible hose into the under-seat depression.

A shower bidet may be constructed of many different materials. In one embodiment, the shower bidet may be constructed with a single piece of polymerized material. For example, the material may include acrylonitrile butadiene styrene (ABS), polyethylene, polypropylene, or other similar plastic material. Such a material may beneficially be durable and resistant to water, soap, and other chemicals common in a shower environment. Such a material may be beneficially be durable and resistant to household cleaners and cleaning devices such as scrubbing brushes. Such material may be treated or coated with antibacterial, anti-microbial, and mold and mildew resistant treatments used in the art.

Figure 1:
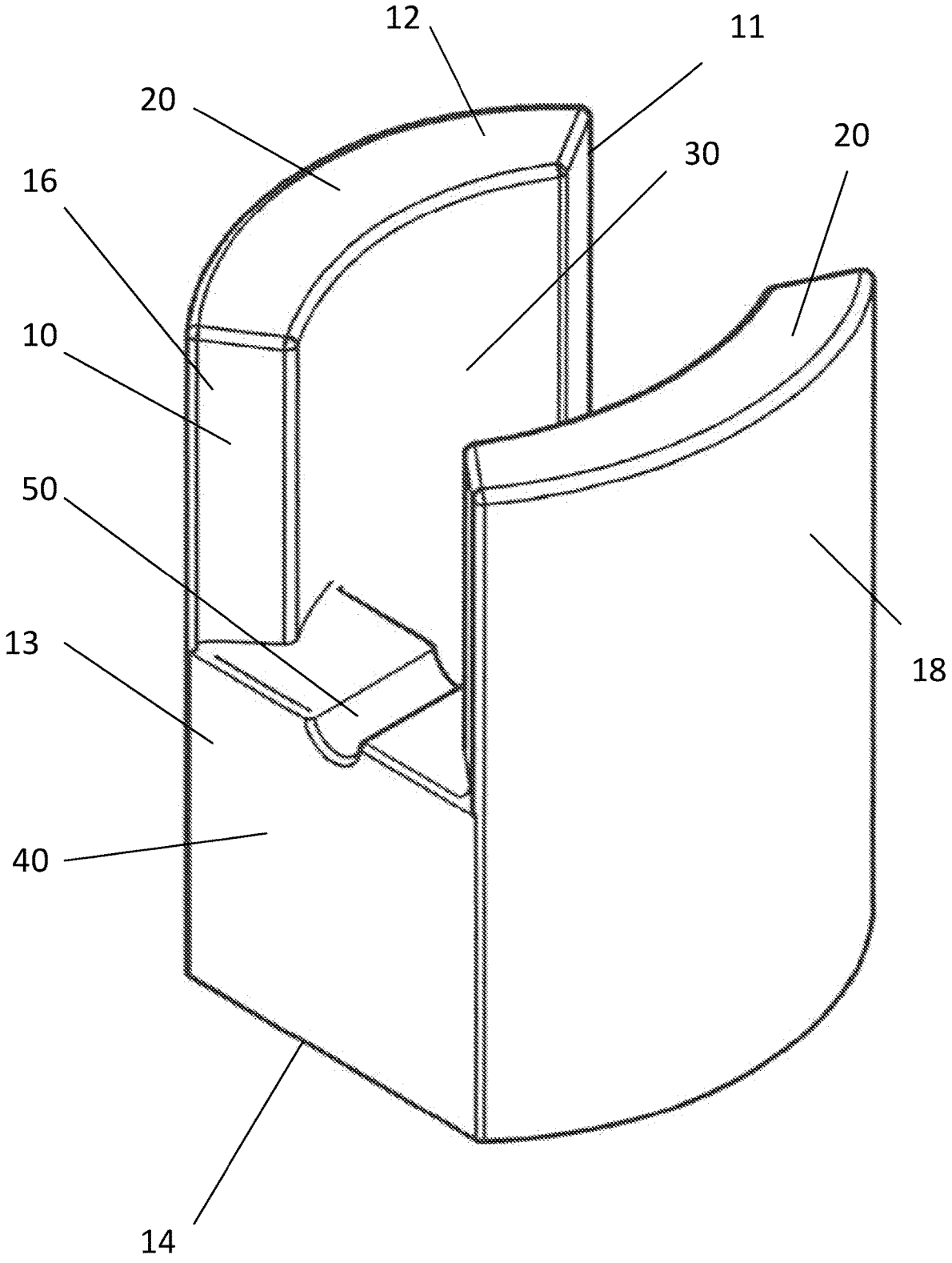
FIG. 1 schematically illustrates in perspective view an exemplary embodiment of a shower bidet, in accordance with the present disclosure.

FIG. 1 schematically illustrates in perspective view an exemplary embodiment of a shower bidet 10. The shower bidet 10 includes a portable, plastic device upon which a user may sit. The shower bidet 10 may include a one piece device formed from a single piece of plastic which may be formed through injection molding, blow molding, vacuum forming, or other process in the art. The shower bidet 10 is illustrated including a top surface 12, a bottom portion 14, a rear portion 13, and a front portion 11. The top surface 12 includes two seating surfaces 20 upon which a user may sit. The top surface 12 terminates along a junction with interior vertical face 30 which defines in interior cavity between the two seating surfaces 20. One of the seating surfaces 20 and the vertical walls supporting the one of the seating surfaces 20 define a first seating column 16. A second of the seating surfaces 20 and the vertical walls supporting the second of the seating surfaces 20 define a second seating column 18. The cavity between the first seating column 16 and the second seating column 18 permits a water spraying nozzle to be disposed within the cavity and point upward, such that a flow of water from the water spraying nozzle may accomplish a sanitary washing function for the user.

The two seating surfaces 20 and vertical walls connected thereto are connected to each other with a bridge portion 40. In the exemplary embodiment of FIG. 1, the bridge portion 40 includes a top surface which is lower than the two seating surfaces 20. The top surface of the bridge portion 40 includes an optional shower spray nozzle attachment feature 50.

The bottom portion 14 may be open, with the side walls of the first seating column 16, the side walls of the second seating column 18, and the side walls of the bridge portion providing exposed edge surfaces which may rest upon a floor surface. In one embodiment, the exposed edge surfaces may be coated with a non-slip or rubberized material. In another embodiment, the bottom portion 14 may be closed, for example, with a flat piece of plastic providing a flat surface upon the bottom portion 14.

Figure 2:
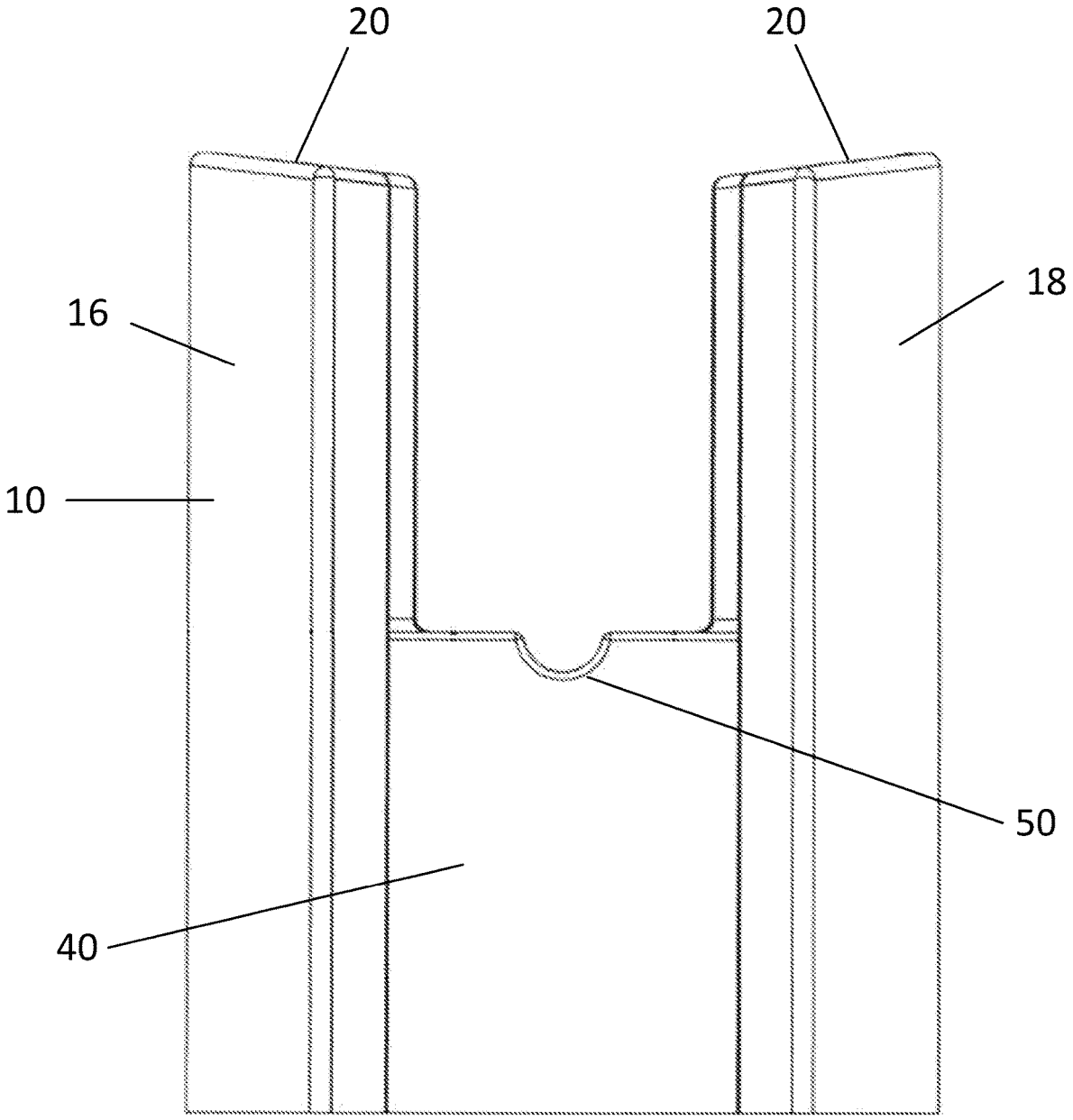
FIG. 2 schematically illustrates in rear view the shower bidet of FIG. 1, in accordance with the present disclosure.

FIG. 2 schematically illustrates in rear view the shower bidet 10. The shower bidet 10 includes the two seating surfaces 20, the first seating column 16, the second seating column 18, and the bridge portion 40. The bridge portion 40 is illustrated including the shower spray nozzle attachment feature 50.

Figure 3:
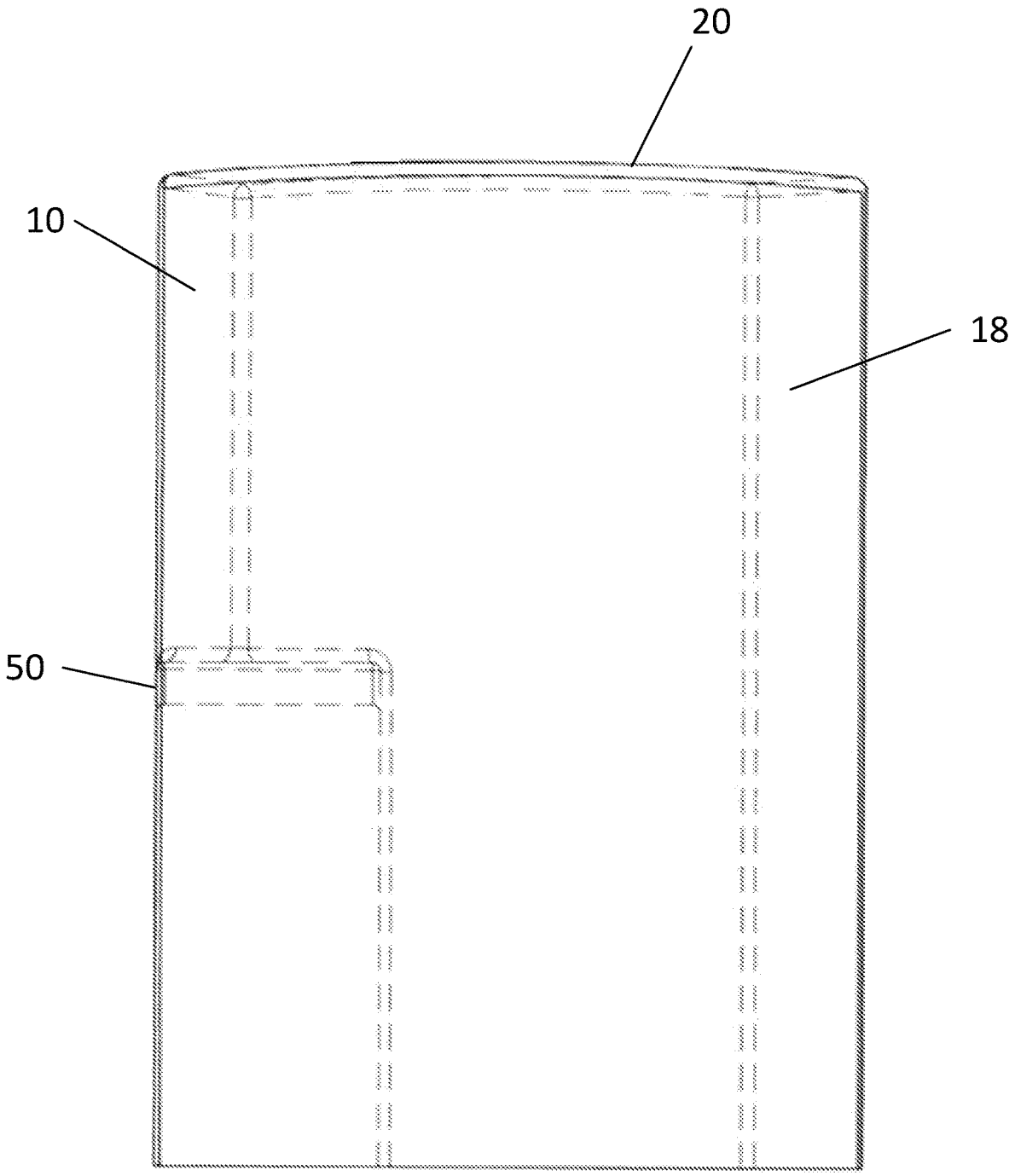
FIG. 3 schematically illustrates in side view the shower bidet of FIG. 1, in accordance with the present disclosure.

FIG. 3 schematically illustrates in side view the shower bidet 10. The shower bidet 10 is illustrated including the second seating column 18 and one of the seating surfaces 20. Details of the shower bidet 10 which are not directly visible in the side view of FIG. 3 including the shower spray nozzle attachment feature 50 are illustrated with dotted lines.

Figure 4:
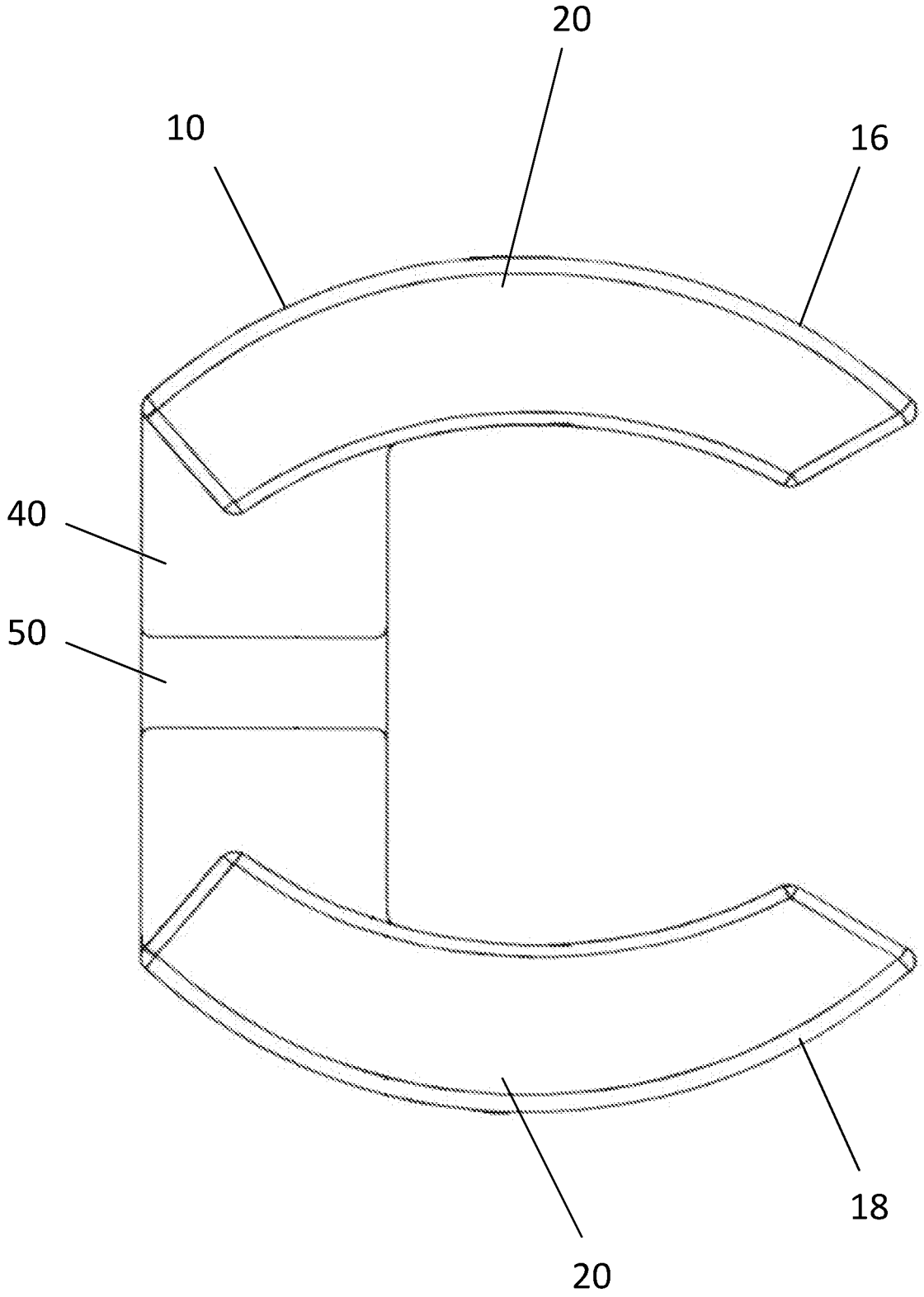
FIG. 4 schematically illustrates in top view the shower bidet of FIG. 1, in accordance with the present disclosure.
Figure 5:
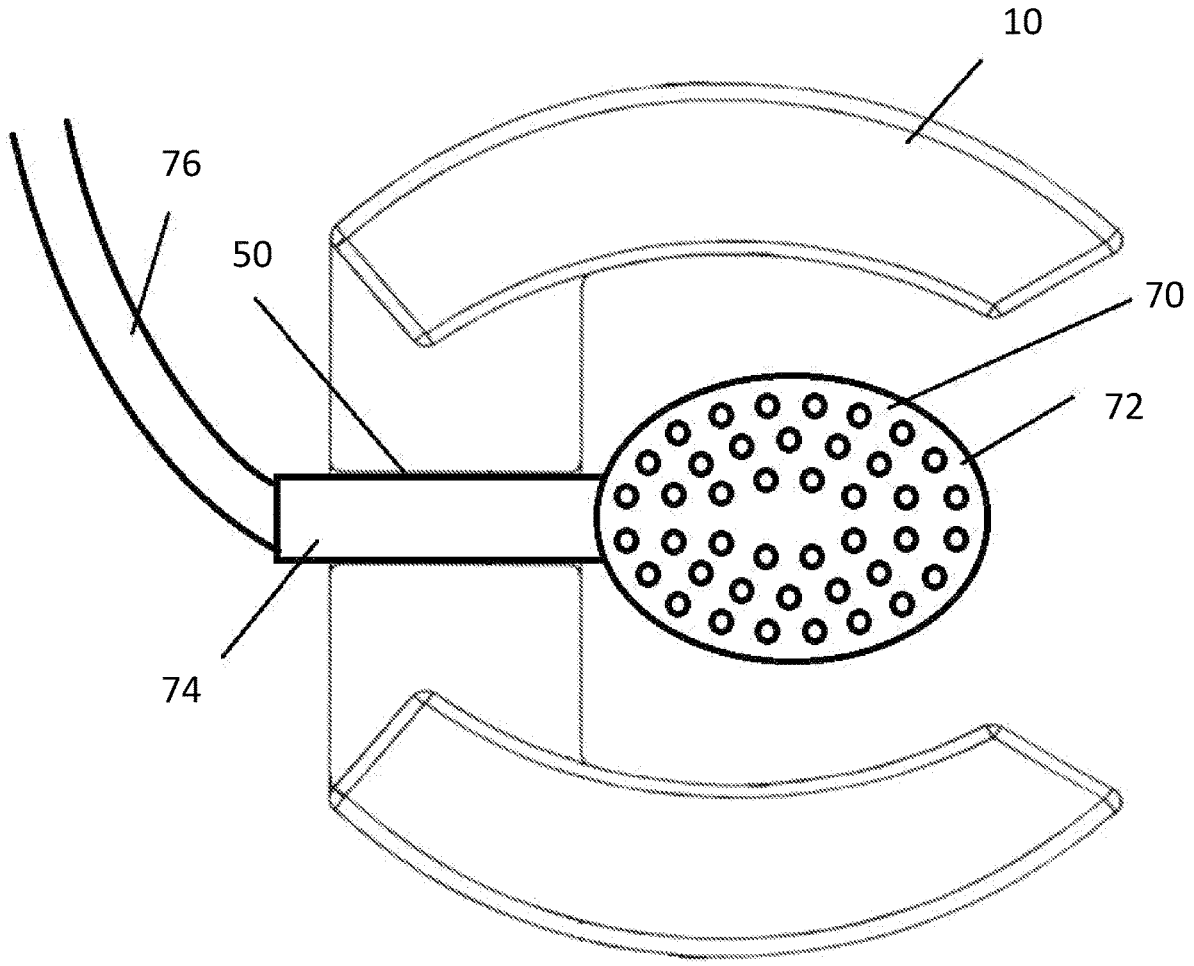
FIG. 5 schematically illustrates in top view the shower bidet of FIG. 1 with a shower spray nozzle attached to the shower bidet, in accordance with the present disclosure.

FIG. 4 schematically illustrates in top view the shower bidet 10. The shower bidet 10 is illustrated including the two seating surfaces 20, the first seating column 16, the second seating column 18, and the bridge portion 40. The shower spray nozzle attachment feature 50 is illustrated. FIG. 5 schematically illustrates in top view the shower bidet 10 with a shower spray nozzle 70 attached to the shower bidet 10. The shower spray nozzle 70 is illustrated including a flexible water supply line 76, a handle portion 74, and a spray nozzle end 72. The handle portion 74 is illustrated affixed to or resting upon the shower spray nozzle attachment feature 50. As water flows from the spray nozzle end 72 and projects upwardly, the flow of water provides a sanitary cleaning function for a user sitting upon the shower bidet 10.

FIG. 5 illustrates a system for a shower bidet. The system includes the shower bidet 10 including a shower spray nozzle attachment feature 50 and a shower spray nozzle 70 attached to the shower bidet 10, wherein the shower spray nozzle 70 includes a flow of water and wherein the shower bidet 10 is configured to direct the flow of water upward from below a seating surface of the shower bidet 10.

Figure 6:
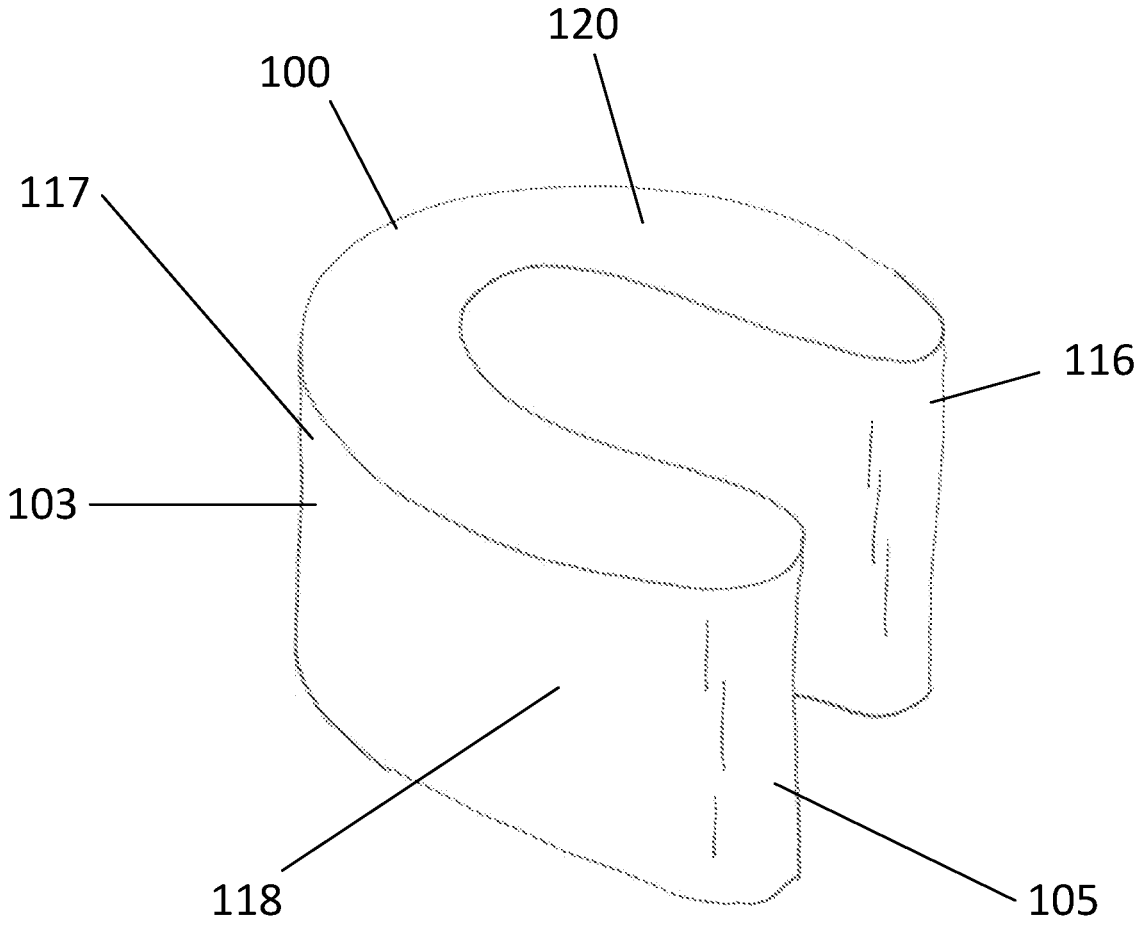
FIG. 6 schematically illustrates in perspective view an alternative embodiment of a shower bidet, with a continuous single seating surface upon a top surface of the shower bidet, in accordance with the present disclosure.

FIG. 6 schematically illustrates in perspective view an alternative embodiment of a shower bidet 100, with a continuous single seating surface 120 upon a top surface of the shower bidet. The continuous single seating surface 120 is U-shaped or in a shape of an open ended toilet seat in the art. The shower bidet 100 is illustrated including a first seating column 116, a second seating column 118. The shower bidet 100 includes continuous walls 117 connecting the first seating column 116 and the second seating column 118 across a rear portion 103 of the shower bidet 100. The first seating column 116 and the second seating column 118 are separate at a front portion 105 of the shower bidet 100, such that a user may manually move a shower spray nozzle with a flexible water supply line into the space between the first seating column 116 and the second seating column 118 to accomplish sanitary washing.

Figure 7:
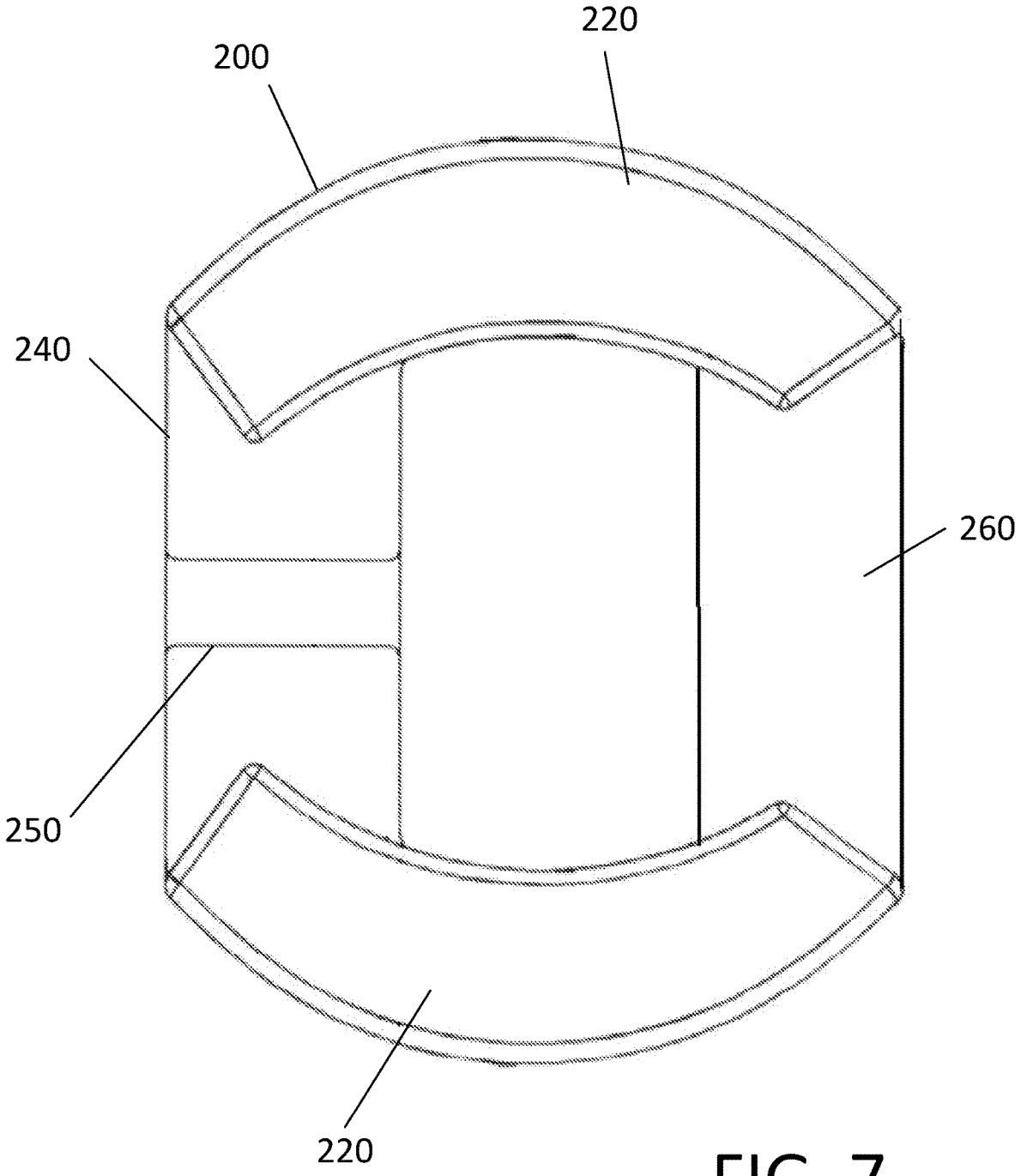
FIG. 7 schematically illustrates in top view an additional alternative embodiment of a shower bidet, including a larger seating surface upon a top surface of the shower bidet and with bridge portions disposed at both a front and rear portion of the shower bidet, in accordance with the present disclosure.

FIG. 7 schematically illustrates in top view an additional alternative embodiment of a shower bidet 200, including a seating surface 220 upon a top surface of the shower bidet 200 and with a first bridge portion 260 disposed at a front portion of the shower bidet 200 and with a second bridge portion 240 disposed at a rear portion of the shower bidet 200. The seating surface 220 may be larger than the seating surface 20 of FIG. 1 to accommodate a larger user. Additionally, the first bridge portion 260 and the second bridge portion 240 collectively unite the walls supporting the seating surface 220 and provide additional support to the vertical walls such that the shower bidet 200 may support additional weight as compared to the shower bidet 10. The second bridge portion 240 is illustrated including a shower spray nozzle attachment feature 250.

Figure 8:
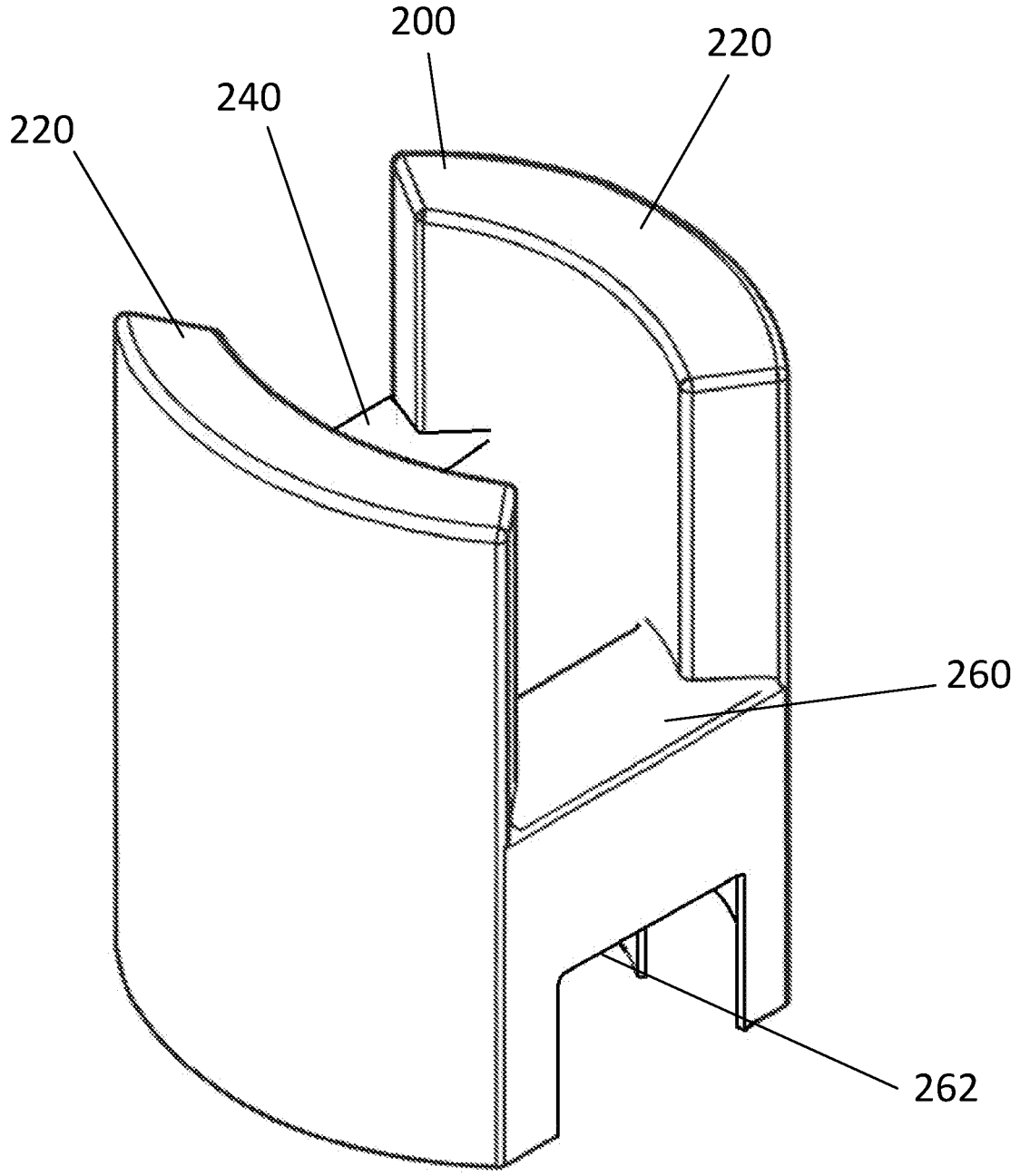
FIG. 8 schematically illustrates in perspective view the shower bidet of FIG. 7, in accordance with the present disclosure.

FIG. 8 schematically illustrates in perspective view the shower bidet 200. The shower bidet 200 is illustrated including the seating surface 220, the first bridge portion 260 and the second bridge portion 240. The first bridge portion 260 is illustrated including a water drain relief 262, a cutout portion configured to permit water sprayed within the area between the two sides of the shower bidet 200 to flow out from the bottom of the shower bidet 200.

Figure 9:
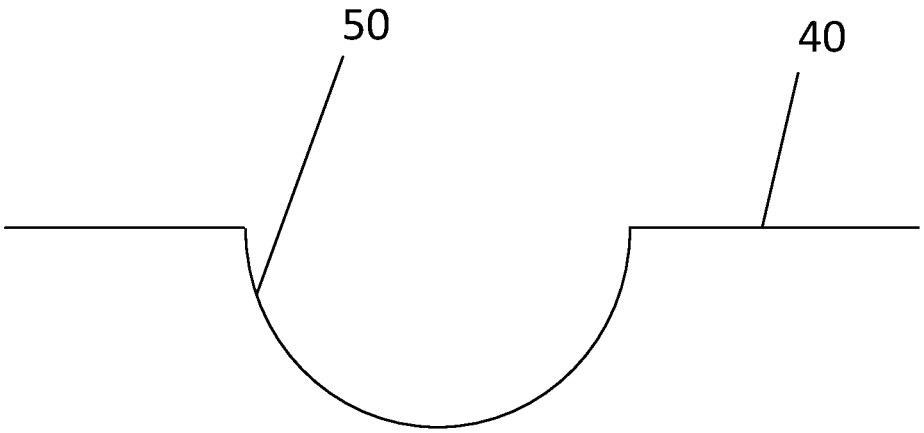
FIG. 9 schematically illustrates the shower spray nozzle attachment feature of FIG. 1, in accordance with the present disclosure.

FIG. 9 schematically illustrates the shower spray nozzle attachment feature 50. The shower spray nozzle feature 50 is illustrated formed in bridge portion 40 and includes an arcuate profile spanning up to one hundred and eighty degrees. A shower spray nozzle may rest upon the shower spray nozzle feature 50. In one embodiment, a fastener or cover feature may be used to fix a shower spray nozzle into the shower spray nozzle feature.

Figure 10:
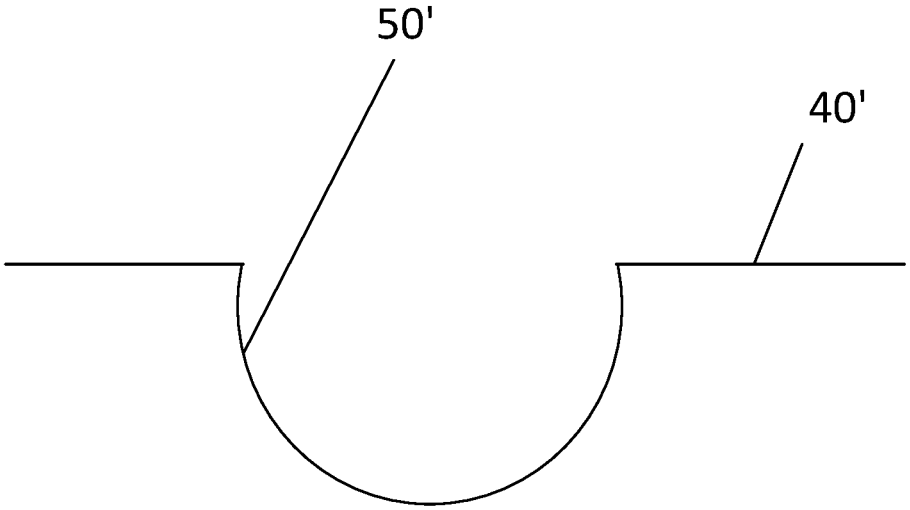
FIG. 10 schematically illustrates an alternative shower spray nozzle attachment feature, including an arcuate profile spanning more than one hundred and eighty degrees to create a snapping connection with a shower spray nozzle, in accordance with the present disclosure.

FIG. 10 schematically illustrates an alternative shower spray nozzle attachment feature 50', including an arcuate profile spanning more than one hundred and eighty degrees to create a snapping connection with a shower spray nozzle. The shower spray nozzle attachment feature 50' is illustrated formed in bridge portion 40'. The shower spray nozzle attachment feature 50', by spanning more than one hundred and eighty degrees may include an interference fit for a handle portion of a shower spray nozzle, permitting the shower spray nozzle to snap into the shower spray nozzle attachment feature 50'.

Figure 11:
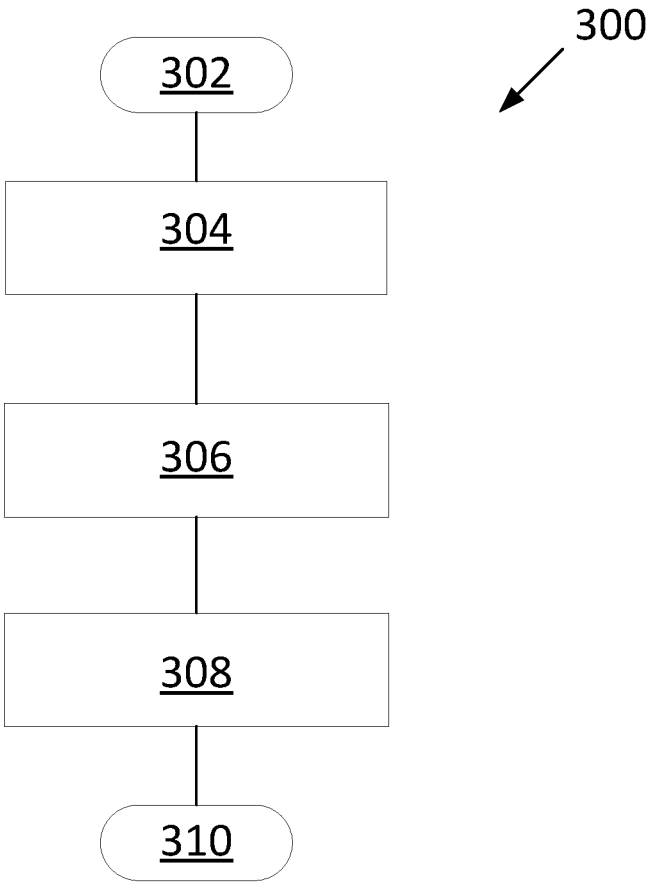
FIG. 11 is a flowchart illustrating a method to utilize a shower bidet, in accordance with the present disclosure.

FIG. 11 is a flowchart illustrating an exemplary method 300 to utilize a shower bidet. The method 300 starts at step 302. At step 304, a user places a plastic shower bidet in a shower stall. In one embodiment, the user places the shower bidet over the shower drain or may situate the shower bidet such that water draining under the shower bidet has a direct path to the shower drain. A direct path to the shower drain may be defined as being upon a nearly horizontal surface where water may drain along the horizontal surface to the shower drain. At step 306, the user affixes a shower spray nozzle attached to a flexible water supply hose to the shower bidet, with the spray nozzle oriented to enable a spray of water in an upward direction under a seating surface or surfaces of the shower bidet. At step 308, the user activates a water flow through the shower spray nozzle, such that the shower bidet may be utilized. At step 310, the method 300 ends. A number of alternative methods are envisioned, and the disclosure is not intended to be limited to the examples provided herein.

While the best modes for carrying out the disclosure have been described in detail, those familiar with the art to which this disclosure relates will recognize various alternative designs and embodiments for practicing the disclosure within the scope of the appended claims.

What is claimed is:

1. A shower bidet, comprising:

a plastic device operable for a user to sit upon, including:

a first seating column including a first interior vertical face;

a second seating column distinct and separate from the first seating column and including a second interior vertical face;

a first seating surface disposed atop the first seating column;

a second seating surface disposed atop the second seating column; and a bridge portion connecting the first seating column and the second seating column; and wherein the first seating surface and the first seating column are separated from the second seating surface and the second seating column such that a spray nozzle may be disposed between the first seating column and the second seating column;

wherein the first interior vertical face and the second interior vertical face are configured to define a cavity therebetween enabling water from the spray nozzle and waste in the water to fall and drain between the first interior vertical face and the second interior vertical face; and wherein the plastic device has a C-shape when viewed from above, wherein the C-shape is configured for enabling a portion of the water draining under the plastic device to have a direct path to a shower drain without contacting the plastic device.

2. The shower bidet of claim 1, wherein the bridge portion includes a shower spray nozzle attachment feature.

3. The shower bidet of claim 2, wherein the shower spray nozzle attachment feature includes an arcuate profile spanning up to one hundred and eighty degrees.

4. The shower bidet of claim 2, wherein the shower spray nozzle attachment feature includes an arcuate profile spanning more than one hundred and eighty degrees.

5. A system for utilizing a shower bidet, comprising:

a plastic device operable for a user to sit upon, including:

a first seating column including a first interior vertical face;

a second seating column distinct and separate from the first seating column and including a second interior vertical face;

a first seating surface disposed atop the first seating column;

a second seating surface disposed atop the second seating column; and a bridge portion connecting the first seating column and the second seating column; and a shower spray nozzle attached to the plastic device, wherein the shower spray nozzle is operable to include a flow of water; and wherein the first seating surface and the first seating column are separated from the second seating surface and the second seating column such that the shower spray nozzle may be disposed between the first seating column and the second seating column;

wherein the shower bidet is operable to direct the flow of water upward from below the first seating surface and the second seating surface;

wherein the first interior vertical face and the second interior vertical face are configured to define a cavity therebetween enabling water from the spray nozzle and waste in the water to fall and drain between the first interior vertical face and the second interior vertical face; and wherein the plastic device has a C-shape when viewed from above, wherein the C-shape is configured for enabling a portion of the water draining under the plastic device to have a direct path to a shower drain without contacting the plastic device.

6. The system of claim 5, wherein the bridge portion includes a shower spray nozzle attachment feature.

7. The system of claim 6, wherein the shower spray nozzle attachment feature includes an arcuate profile spanning up to one hundred and eighty degrees.

8. The system of claim 6, wherein the shower spray nozzle attachment feature includes an arcuate profile spanning more than one hundred and eighty degrees.

9. A method to utilize a shower bidet, comprising:

placing the shower bidet within a shower, wherein the shower bidet has a C-shape when viewed from above and wherein the C-shape is configured for enabling a portion of water draining under the shower bidet to have a direct path to a shower drain without contacting the shower bidet, wherein the shower bidet includes:

a plastic device operable for a user to sit upon, including:

a first seating column including a first interior vertical face;

a second seating column distinct and separate from the first seating column and including a second interior vertical face;

a first seating surface disposed atop the first seating column;

a second seating surface disposed atop the second seating column; and a bridge portion connecting the first seating column and the second seating column, wherein the first seating surface and the first seating column are separated from the second seating surface and the second seating column such that a spray nozzle may be disposed between the first seating column and the second seating column and wherein the first interior vertical face and the second interior vertical face are configured to define a cavity therebetween enabling water from the spray nozzle and waste in the water to fall between the first interior vertical face and the second interior vertical face;

affixing the shower spray nozzle attached to a flexible water supply hose to the shower bidet, wherein the spray nozzle oriented to enable a spray of water in an upward direction under the first seating surface and the second seating surface; and activating a water flow through the shower spray nozzle.

* * * * *